US012404642B2

(12) United States Patent
Greer et al.

(10) Patent No.: US 12,404,642 B2
(45) Date of Patent: Sep. 2, 2025

(54) PREFORMED THERMOPLASTIC PAVEMENT MARKING AND METHOD UTILIZING LARGE AGGREGATE FOR IMPROVED LONG TERM SKID RESISTANCE AND REDUCED TIRE TRACKING

(71) Applicant: ENNIS-FLINT, INC., Greensboro, NC (US)

(72) Inventors: Robert W. Greer, Lexington, NC (US); Simon Yakopson, Hickory, NC (US)

(73) Assignee: Ennis-Flint, Inc., Greensboro, NC (US)

( * ) Notice: Subject to any disclaimer, the term of this patent is extended or adjusted under 35 U.S.C. 154(b) by 0 days.

(21) Appl. No.: 15/645,785

(22) Filed: Jul. 10, 2017

(65) Prior Publication Data

US 2017/0306576 A1 Oct. 26, 2017

Related U.S. Application Data

(63) Continuation of application No. 12/592,458, filed on Nov. 25, 2009, now Pat. No. 9,732,481, which is a continuation-in-part of application No. 10/816,635, filed on Apr. 2, 2004, now Pat. No. 7,645,503.

(51) Int. Cl.
*E01F 9/512* (2016.01)

(52) U.S. Cl.
CPC ..... *E01F 9/512* (2016.02); *Y10T 428/24372* (2015.01)

(58) Field of Classification Search
CPC ..... E01F 9/512; Y10T 428/24372
See application file for complete search history.

(56) References Cited

U.S. PATENT DOCUMENTS 178,341 A 6/1876 Snook
1,622,103 A 3/1927 James
D87,650 S 8/1932 Solon
(Continued)

FOREIGN PATENT DOCUMENTS

CA 2329151 A1 6/2002
CA 2 781 855 7/2019
(Continued)

OTHER PUBLICATIONS

U.S. Appl. No. 09/896,795, filed Jun. 29, 2001, Wallgren.
(Continued)

*Primary Examiner* — Michael Zhang
(74) *Attorney, Agent, or Firm* — Kilpatrick Townsend & Stockton LLP

(57) ABSTRACT

The present disclosure describes a preformed or in some cases a hot applied thermoplastic marking composition comprising a planar top surface portion and a planar bottom surface portion that are coplanar to each other, wherein said bottom surface portion is directly applied to a substrate via application of heat or pressure or both heat and pressure and wherein said top surface portion comprises an intermix that exits throughout said thermoplastic composition and includes large grit size aggregate in the range of about 8 to about 20 mesh or grit size, thereby reducing or eliminating tire tracking while also improving long-term skid resistance.

27 Claims, 1 Drawing Sheet

(56) References Cited

U.S. PATENT DOCUMENTS

| | | | |
|---|---|---|---|
| 2,049,428 | A | 8/1936 | Denk |
| 3,364,242 | A | 1/1968 | Johnson et al. |
| 3,664,242 | A | 5/1972 | Harrington et al. |
| 3,935,365 | A | 1/1976 | Eigenmann |
| 3,958,891 | A | 5/1976 | Eigenmann |
| 4,020,211 | A | 4/1977 | Eigenmann |
| 4,075,049 | A | 2/1978 | Wood |
| 4,142,265 | A | 3/1979 | Pfleger |
| 4,361,328 | A | 11/1982 | Stein et al. |
| 4,717,620 | A | 1/1988 | Bowen et al. |
| 4,937,124 | A | 6/1990 | Pafilis |
| 5,053,253 | A | 10/1991 | Haenggi et al. |
| 5,077,117 | A | 12/1991 | Harper et al. |
| 5,077,177 | A | 12/1991 | Frass et al. |
| 5,094,902 | A | 3/1992 | Haenggi et al. |
| 5,215,402 | A | 6/1993 | Stowell et al. |
| 5,238,721 | A | 8/1993 | Nakazawa |
| 5,271,690 | A | 12/1993 | Fennessy, Sr. |
| 5,385,770 | A | 1/1995 | Julnes |
| 5,418,036 | A | 5/1995 | Tokikawa et al. |
| 5,437,907 | A | 8/1995 | Peil et al. |
| 5,494,372 | A | 2/1996 | Oliver et al. |
| 5,509,715 | A | 4/1996 | Scharpf |
| 5,536,569 | A | 7/1996 | Lasch et al. |
| 5,557,461 | A | 9/1996 | Wyckoff |
| 5,593,246 | A | 1/1997 | Hedblom et al. |
| 5,653,552 | A | 8/1997 | Wiley et al. |
| 5,759,928 | A | 6/1998 | Harper |
| 5,775,835 | A | 7/1998 | Szekely |
| 5,804,285 | A | 9/1998 | Kobayashi et al. |
| 5,820,993 | A | 10/1998 | Schall et al. |
| 5,861,206 | A | 1/1999 | Jensen |
| 5,895,171 | A | 4/1999 | Wiley et al. |
| 5,900,180 | A | 5/1999 | Scott et al. |
| 5,906,889 | A | 5/1999 | Miron |
| 6,020,047 | A | 2/2000 | Everhart |
| 6,024,511 | A | 2/2000 | Ross |
| 6,051,297 | A | 4/2000 | Maier et al. |
| D425,633 | S | 5/2000 | Hunter |
| 6,116,814 | A | 9/2000 | Dietrichson |
| D437,858 | S | 2/2001 | Shigeya et al. |
| 6,217,252 | B1 | 4/2001 | Tolliver et al. |
| 6,217,254 | B1 | 4/2001 | Wallgren et al. |
| 6,253,512 | B1 | 7/2001 | Thompson et al. |
| 6,365,262 | B1 | 4/2002 | Hedblom et al. |
| 6,371,689 | B1 | 4/2002 | Wiley |
| 6,382,871 | B1 | 5/2002 | Ross |
| 6,413,010 | B2 | 7/2002 | Coleman |
| 6,431,788 | B1 | 8/2002 | Hedblom et al. |
| 6,449,790 | B1 | 9/2002 | Szekely |
| 6,468,678 | B1 | 10/2002 | Dahlin et al. |
| 6,543,196 | B1 | 4/2003 | Gonzales |
| 6,576,074 | B1 | 6/2003 | Cabrera et al. |
| 6,588,975 | B2 | 7/2003 | Ross |
| 6,656,566 | B1 | 12/2003 | Kuykendall et al. |
| 6,656,567 | B1 | 12/2003 | Abe et al. |
| 6,679,650 | B2 | 1/2004 | Britt et al. |
| 6,694,652 | B1 | 2/2004 | Jeha |
| 6,751,916 | B1 | 6/2004 | Ritzer et al. |
| 6,769,837 | B1 | 8/2004 | Ross |
| 6,790,880 | B2 | 9/2004 | Purgett et al. |
| 6,811,860 | B2 | 11/2004 | Kemp |
| 6,830,475 | B2 | 12/2004 | Jazowski et al. |
| 6,861,141 | B2 | 3/2005 | Buccellato et al. |
| 6,890,124 | B2 | 5/2005 | Provenzano, III |
| 6,895,622 | B2 | 5/2005 | Szekely |
| D509,596 | S | 9/2005 | Cant |
| 6,939,078 | B1 | 9/2005 | Anderson et al. |
| 6,951,435 | B1 | 10/2005 | Fennessy, Sr. |
| 6,988,010 | B2 | 1/2006 | Taniguchi et al. |
| 7,001,102 | B2 | 2/2006 | Dennison |
| 7,066,680 | B2 | 6/2006 | Wiley |
| 7,238,406 | B2 | 7/2007 | Peterson |
| 7,645,503 | B1 | 1/2010 | Greer et al. |
| 7,735,277 | B1 | 6/2010 | Everhart et al. |
| 7,753,616 | B2 | 7/2010 | Greer et al. |
| D625,322 | S | 10/2010 | Guntaur et al. |
| 8,119,202 | B2 | 2/2012 | Wiley |
| 8,133,540 | B2 | 3/2012 | Wiley et al. |
| D670,721 | S | 11/2012 | Yang et al. |
| D689,627 | S | 9/2013 | Parker et al. |
| D690,032 | S | 9/2013 | Parker et al. |
| 8,573,882 | B2 * | 11/2013 | Greer ..... G09F 7/12 404/12 |
| D706,041 | S | 6/2014 | Korkala et al. |
| 8,864,409 | B2 | 10/2014 | Parker |
| D721,774 | S | 1/2015 | Gamble |
| D745,880 | S | 12/2015 | Lima et al. |
| D748,131 | S | 1/2016 | Kovacevic et al. |
| D748,665 | S | 2/2016 | Steplyk |
| D749,619 | S | 2/2016 | Coburn et al. |
| D754,679 | S | 4/2016 | Gobinski et al. |
| D757,762 | S | 5/2016 | Guesnon, Jr. |
| D757,813 | S | 5/2016 | Giguere et al. |
| D758,394 | S | 6/2016 | Weber |
| D763,282 | S | 8/2016 | Lee |
| D764,524 | S | 8/2016 | Hoang et al. |
| D765,670 | S | 9/2016 | Osotio et al. |
| D765,673 | S | 9/2016 | Leabman |
| 2001/0055678 | A1 | 12/2001 | Murata et al. |
| 2002/0141821 | A1 | 10/2002 | Guidon |
| 2003/0012599 | A1 | 1/2003 | Wallgren et al. |
| 2003/0070579 | A1 | 4/2003 | Hong et al. |
| 2003/0091794 | A1 | 5/2003 | Jing et al. |
| 2003/0123931 | A1 | 7/2003 | Khieu et al. |
| 2003/0147695 | A1 | 8/2003 | Hong et al. |
| 2004/0042850 | A1 | 3/2004 | Provenzano, III |
| 2004/0067336 | A1 | 4/2004 | Munroe, II |
| 2005/0031415 | A1 | 2/2005 | Sippola |
| 2005/0066623 | A1 | 3/2005 | Sippola |
| 2005/0144743 | A1 | 7/2005 | Szekely |
| 2006/0056912 | A1 | 3/2006 | Altmann et al. |
| 2006/0264546 | A1 * | 11/2006 | Nagaoka ..... C08K 5/0008 524/394 |
| 2006/0285920 | A1 | 12/2006 | Gettig et al. |
| 2007/0077119 | A1 * | 4/2007 | Northey ..... E01F 9/578 404/12 |
| 2007/0218238 | A1 | 9/2007 | Greer |
| 2008/0145146 | A1 | 6/2008 | Shipman et al. |
| 2008/0236008 | A1 | 10/2008 | Greer et al. |
| 2010/0071832 | A1 | 3/2010 | Greer et al. |
| 2010/0101738 | A1 | 4/2010 | Luomanen et al. |
| 2011/0059295 | A1 | 3/2011 | Greer et al. |
| 2011/0123769 | A1 * | 5/2011 | Greer ..... G09F 7/12 428/143 |
| 2011/0123770 | A1 | 5/2011 | Greer et al. |
| 2013/0074385 | A1 | 3/2013 | Greer et al. |
| 2013/0170813 | A1 | 7/2013 | Woods et al. |
| 2013/0179761 | A1 | 7/2013 | Cho et al. |
| 2014/0165435 | A1 | 6/2014 | Greer et al. |
| 2015/0140294 | A1 | 5/2015 | Yakopson et al. |
| 2015/0186538 | A1 | 7/2015 | Yan et al. |
| 2015/0330035 | A1 | 11/2015 | Lamar |
| 2016/0060829 | A1 * | 3/2016 | Greer ..... E01C 23/206 404/94 |

FOREIGN PATENT DOCUMENTS

| | | | |
|---|---|---|---|
| GB | 2030586 | A | 4/1980 |
| GB | 2 255 099 | | 10/1992 |
| GB | 2429978 | A | 3/2007 |
| JP | 09-013487 | A | 1/1997 |
| JP | 09-124974 | A | 5/1997 |
| JP | 2005-344441 | A | 12/2005 |
| MX | 353704 | | 1/2018 |
| RU | 135323 | U1 | 12/2013 |
| WO | WO 93/07339 | | 4/1993 |
| WO | WO 99/25928 | | 5/1999 |
| WO | WO03064771 | A1 | 8/2003 |
| WO | 2007/059175 | | 5/2007 |
| WO | 2007/143988 | | 12/2007 |

(56) References Cited

FOREIGN PATENT DOCUMENTS

| | | | |
|---|---|---|---|
| WO | 2009/005553 | A2 | 1/2009 |
| WO | 2011/066348 | A2 | 6/2011 |

OTHER PUBLICATIONS

U.S. Appl. No. 10/000,448 filed Dec. 4, 2001, Wiley.
U.S. Appl. No. 10/002,105, filed Dec. 5, 2001, Ross.
U.S. Appl. No. 10/497,354 filed Nov. 30, 2004, Wiley.
Brochure from 3M for Stamark Wet Reflective Pavement Marking Tape Series 820; 2001.
Brochure from Flint 2000EX for propane gas fired industrial heat torch with cold burning nozzle; 2002.
Brochure from Integrated Paving Concepts, Inc. for decorative thermoplastic pavement markings (undated).
Brochure from Jarvis for Imprint paving material (undated).
Brochure from Jarvis for Imprint; a synthetic surface; Jul. 2003.
Brochure from Jarvis for Stonegrip surface treatment and Tyregrip surface treatment (undated).
Horizontal Signage; for Preformed Thermoplastic Pavement Marking Material; Flint Trading, Inc.; 3 pages.
Loctite Equipment operation manual for Hysol 175-Spray; 5 pages; 2001.
Logos which can be used for pavement markings; Flint Trading, Inc.; 2002; one page.
Owen et al., "Earth Lab: Exploring the Earth Sciences," 3rd Edition, Brooks/Cole Cengage Learning 2011, p. 22.
Particle Size Conversion Table. http://www.sigmaaldrich.com/chemistry/stockroom-reagents/learning-center/technical-library/particle-size-conversion.html. Accessed: Aug. 10, 2012.
Printout from Arizona Chemical webpage for Roadmarking (undated).
Shin-Etsu Data Sheet 70 Durometer Fast Cure LIMS; one (1) page undated.
Shin-Etsu LIMS Molding System For The New Age; eleven (11) pages; dated 2000.
Shin-Etsu LIMS Product Selection Guide, three (3) pages; dated 2005.
Shin-Etsu MSDS No. EU-06-07203067; Material Safety Data Sheet; six (6) pages; dated Jan. 8, 2004.
Shin-Etsu Silicone LIMS Liquid Injection Molding System; five (5) pages; dated 2001.
U.S. Appl. No. 14/506,248, Final Office Action, Apr. 11, 2019, 13 pages.
U.S. Appl. No. 14/506,248, Non-Final Office Action, Oct. 26, 2018, 13 pages.
U.S. Appl. No. 15/645,421, Final Office Action, Oct. 28, 2019, 10 pages.
U.S. Appl. No. 15/645,421, Final Office Action, Jan. 8, 2021, 22 pages.
U.S. Appl. No. 15/645,421, Non-Final Office Action, Apr. 15, 2019, 16 pages.
U.S. Appl. No. 15/645,421, Non-Final Office Action, Jun. 16, 2020, 18 pages.
CA 2,781,855, Notice of Allowance, Nov. 19, 2018, 1 page.
CA 2,781,855, Office Action, Feb. 16, 2018, 4 pages.
EP 15860732.5, Extended European Search Report, Aug. 8, 2018, 10 pages.
EP 15860732.5 , Office Action, Apr. 30, 2019, 7 pages.
13, 15, 16, 18, 20 and 24 are undated but were commercially available prior to applicant's conception of the present invention.
25+ Best Responsive Admin Dashboard Templates, posted at Webprecis, posting date Mar. 24, 2015. [online], [site visited Jun. 15, 2016]. Available from Internet, <URL: http://www.webprecis.com/best-responsive-admin-dashboard-templates/>.
Arizona Chemical, Hot Melt Polyamide Adhesives, Product brochure. Jul. 2011. www.arizonachemical.com.
Specification Preformed Thermoplastic Pavement Markings; 3 pages (undated).
Dang Liam, 30+ Free & Premium Admin Templates for Web Application, posted at Magazine Hive, posting date Jun. 25, 2013. [online], [site visited Jun. 15, 2016]. Available from Internet, <URL: http://www.magazinehive.com/2013/06/admin-templates/>.
Federal Institute of Industrial Property (ISA/RU). International Search Report for PCT/US2015/032548, dated Feb. 4, 2016.
http://eastcoastcreativeblog.com/2013/08/diy-herringbone-tile-floor-using-peel.html Posted Aug. 10, 2013.
http://nikinikinine.blogspot.com/2012/08/the-best-laid-tile.html Posted Aug. 22, 2012.
http://www.ennisflintamericas.com/by-brand/trafficscapes/trafficscapes-trafficpatternsgf-grout-free-decorative-crosswalks Retrieved Aug. 26, 2016.
http://www.ennisflintamericas.com/gallery/category/?cat=68 Retrieved Aug. 26, 2016.
http://www.euroitaliastone.com/running_bond.php Available Aug. 6, 2013.
http://www.omnexus4adhesives.com/bc/tapes-channel/index.aspx?id=hot-melts.
http://www.patternpaving.com/stampedcable.html Available Feb. 3, 2015.
Israel Patent Office (ISA/ILPO). International Search Report for PCT/US2015/056965. Mail date: Feb. 22, 2016.
Multi-Color Interconnected Preformed Thermoplastic Pavement Marking Material, Traffic Patterns GF Grout Free 125, Mar. 12, 2015, p. 1-2.
Owen, Claudia, Diane Pirie, and Greenwille Draper. Earth Lab: Exploring the Earth Sciences, 3rd Edition. Brooks/Cole Cengage Learning. 2011. p. 22.
Rocky, 18 Free Backend Admin Panel and Dashboard Templates, posted at Artatm, posting year 2012. [online], [site visited Jun. 15, 2016]. Available from Internet, <URL: http://artatm.com/2012/08/18-free-backend-admin-panel-and-dashboard-templates/>.
U.S. Appl. No. 09/896,795, filed Jun. 29, 2001, Magnus Wallgren.
U.S. Appl. No. 10/000,448, filed Dec. 4, 2001, Patrick Carl Wiley.
U.S. Appl. No. 10/002,105, filed Dec. 5, 2001, Guy Ross.
U.S. Appl. No. 10/497,354, filed Nov. 30, 2004, Patrick Carl Wiley.
www.flinttrading.com, 2012, USA.

* cited by examiner

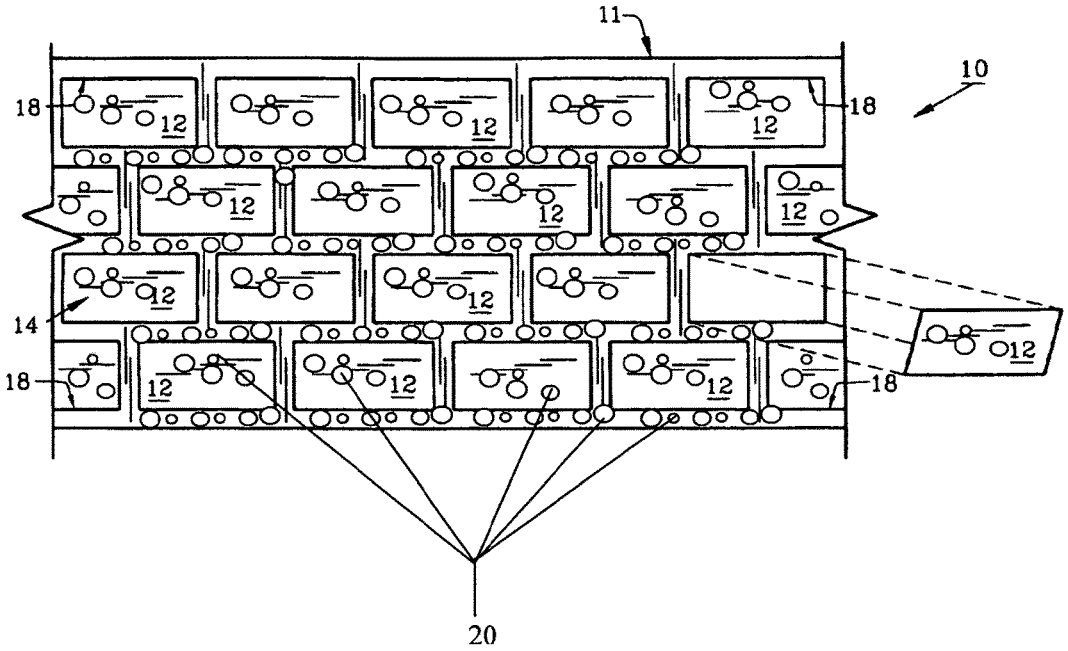
11
10
18
12
14
20

PREFORMED THERMOPLASTIC PAVEMENT MARKING AND METHOD UTILIZING LARGE AGGREGATE FOR IMPROVED LONG TERM SKID RESISTANCE AND REDUCED TIRE TRACKING

PRIORITY

The present application is a continuation of and claims the benefit of priority to U.S. patent application Ser. No. 12/592,458 entitled "Preformed Thermoplastic Pavement Marking and Method Utilizing Large Aggregate for Improved Long Term Skid Resistance and Reduced Tire Tracking", filed Nov. 25, 2009, which is a continuation-in-part of and claims priority under 35 U.S.C. § 120 from U.S. patent application Ser. No. 10/816,635 entitled, "Pavement Marking Pattern and Method", filed 2 Apr. 2004.

FIELD OF THE INVENTION

The invention herein pertains to thermoplastic pavement marking materials comprising large grit size aggregate to improve long-term skid resistance and reduce tire tracking, and particularly pertains to such markers as lines, legends, arrows, indicia, and decorative marking including pavement marking patterns utilizing thermoplastic sheeting which utilize an adhesive (sprayable or otherwise) to maintain the integrity of the pattern prior to its application to a substrate.

BACKGROUND OF THE INVENTION

Traffic markings convey information to drivers and pedestrians by providing exposed visible, reflective, colored and/or tactile surfaces that serve as indicia. In the past, such a function was typically accomplished by painting a traffic surface. Modern marking materials offer significant advantages over paint such as dramatically increased visibility and/or reflectance, improved durability, and temporary removable marking options. Examples of modern pavement marking materials are thermoplastic, pavement marking sheet materials, tapes and raised pavement markers.

Preformed and hot applied thermoplastic materials used as pavement markings or for other indicia possess many advantages compared to paints and other less durable markings. These materials can be used for years. Known materials using high friction aggregates on the surface to improve friction has been known. The surface applied aggregates provide good initial values, however as the surface is worn due to traffic, the skid resistance decreases. After surface layers containing anti-skid materials become worn out these aggregate materials loose their effectiveness and become slippery because they do not contain high friction particles (of sufficient size to provide good skid properties).

Current thermoplastics include small particulate aggregate to improve the skid-resistant properties of the markers. However, over time, it has been shown that when such particulates are too small, they become worn too quickly and thus do not provide sufficient skid-resistance for high traffic areas. Today's thermoplastic materials do not include properties of long-term skid resistance and reduced tire tracking. In addition today's preformed thermoplastic decorative patterned materials do not include both the properties of facilitated assembly via an adhesive spray and long-term skid resistance and reduced tire tracking.

A review of these issues demonstrates the need for thermoplastic products that both reduces tire tracking and improves long term skid resistance once the marking product has been installed on the road surface and also ensures that the integrity of the product (and pattern if so desired) is maintained during handling and installation.

DESCRIPTION OF RELEVANT ART

U.S. Pat. No. 3,958,891 to Eigenmann, Ludwig, and not assigned, describes an aggregate for securing in a layer of material which is used to form a traffic-regulating indicium, so as to improve the nighttime visibility characteristics and anti-skid characteristics of the traffic-regulating indicium. The aggregate comprises a core body surrounded at least partially by a mass of shock-absorbent binder substance and a plurality of elements that improve either nighttime visibility or anti-skid properties, or both. The elements are arranged in and bound by the binder substance such that the latter substantially fills the interspaces between at least the majority of adjacent pairs of the aforementioned elements, some of which being arranged adjacent to an external surface of the mass so as to impart a roughened texture to the external surface, thereby permitting the aggregate to be firmly secured in the traffic-regulating indicium. The remainder of the elements are distributed among different levels interiorly of the mass so that progressive wear of the aggregate and concomitant detachment of elements from the aggregate causes exposure of others of the elements, thereby conveying long-term durability to the traffic-regulating indicium.

U.S. Pat. No. 4,020,211 to Eigermann, Luwig and not assigned describes a new material adapted to be laid down and adhesively secured on a road surface to provide a traffic regulating sign with the material which has an upper surface exposed to traffic and provided with a plurality of sharp tips projecting above the surface for imparting good non-skid properties thereto, the new material comprising an upper layer adjacent to the upper surface, at least partially embedding hard particles to form sharp tips and consists of a polymeric resin having a high molecular cohesion such as a polyamide resin, a polyurethane resin or a polyterephthalic resin, thereby adding improved wear resistance properties to non-skid and high visibility properties.

U.S. Pat. No. 4,937,124 to Pafilis, Michail and not assigned, describes a nonskid element as an antislipping means on a carpet-like floor covering. The nonskid element is a web that includes a plain bottom wall, and the bottom wall includes a covering with band-like holding pins.

U.S. Pat. No. 5,077,117 to Harper, et. al., describes a pavement marking material comprising a flexible base sheet that is conformable to an irregular pavement surface. A durable, wear-resistant, polymeric top layer is adhered to one surface of the base sheet. The top layer is capable of undergoing brittle fracture at a temperature from 0 degrees Centigrade to 45 degrees Centigrade such that when the base sheet conforms to an irregular surface the top layer readily forms ruptures to relieve stress build-up in the top layer as the regions of the top layer defined by the ruptures remain adhered to and follow the conformance of the base sheet. A plurality of particles are embedded in and protrude from the top layer. The particles comprise retroreflective beads and skid-resistant granules. In a preferred embodiment, the top layer is characterized by a Young's modulus of from about 50,000 psi to about 300,000 psi, and a percent elongation at break of from about 4% to about 35%.

U.S. Pat. No. 6,217,252 to Tolliver, Howard R, et. al., and assigned to 3M, describes a method for marking a transportation surface in which the surface is heated to a temperature above the ambient temperature and a finely-divided, free flowing, flame-sprayable, powder binder material selected from the group consisting of acrylic polymers and copolymers, olefin polymers and copolymers having a number average molecular weight greater than 10,000, urethane polymers and copolymers, curable epoxy resins, ester polymers and copolymers, and blends thereof is melted or substantially softened. The molten or softened binder is then applied to the surface with a particulate topcoat or particulate filler selected from the group consisting of reflective elements; skid-resistant particles, magnetizable particles and mixtures thereof, and finally the applied materials are allowed to cool to form a marker in which the binder adheres directly to the surface.

U.S. Pat. No. 3,935,365 to Eigenmann, Ludwig, and not assigned, describes a tape material for securement to primer layers provided on roadway pavements so as to form traffic-regulating indicia on the latter. The tape material comprises a first layer that contains a polymeric binder having high molecular cohesion and one surface adapted to face towards a roadway pavement and another surface adapted to be exposed to traffic, a plurality of hard particles having a minimum of about 6 on the Mohs' Hardness Scale, some of which should have a sharp tip, distributed among various levels of the aforementioned first layer, and a second layer adapted to be secured to a primer layer on the roadway pavement bonded to one surface of the first layer. The second layer is compatible with the first layer so that a firm bond is formed between them. It is also compatible with the primer layer so that a bond forms between them when the tape material is placed on the primer layer. This tape material imparts good anti-ski properties to a traffic-regulating indicium formed therewith due to the presence of the tips of the hard particles, which provide gripping areas when exposed. It is also an effective skid-resister during wear of the traffic-regulating indicium due to the distribution of the hard particles among various levels of the first layer, which enables fresh hard particles to become exposed as hard particles next to the latter are removed by wear.

U.S. Pat. No. 5,053,253 to Haenggi, Robert, et. al., and assigned to Minnesota Mining and Manufacturing Company, describes a method of producing skid-resistant substrate marking sheet in which a base sheet is provided and an upward face of the base sheet is coated with a liquid bonding material. A plurality of ceramic skid-resistant spheroids is embedded in the liquid bonding material, wherein the ceramic spheroids are characterized by having rounded surfaces and no substantial points and characterized by Krumbein roundness of at least 0.8. The liquid bonding material is then cured to a solid adherent polymeric matrix coating with the ceramic skid-resistant spheroids partially embedded, wherein the spheroids comprise a fired ceramic made from various raw materials.

U.S. Pat. No. 5,094,902 to Haenggi, Robert, et. al., and assigned to Minnesota Mining and Manufacturing Company, describes a skid-resistant, surface marking material, comprising a polymer matrix phase having a top surface and a plurality of opaque, skid-resistant ceramic spheroids partially embedded in and protruding from the top surface of the polymer matrix phase, wherein said ceramic spheroids have rounded surfaces and no substantial points, and wherein said ceramic spheroids have a Krumbein roundness of at least 0.8.

U.S. Pat. No. 6,679,650 to Britt, Jerry, et. al., and assigned to Ennis Paint Incorporated, describes a marked pavement system comprising a pavement surface, a first marking stripe adhered to the top of the pavement surface with a thickness of at least about 40 mils to about 110 mils and comprised of a solidified thermoplastic resin composition with a black pigment, and a second marking stripe adhered to the surface of the first marking stripe with a thickness of at least 40 mils to 750 mils. The second marking stripe should be narrower than the first marking stripe and comprised of a solidified thermoplastic resin composition with a pigment that visibly contrasts with the first marking stripe, wherein the marked pavement system is highly visible during the daylight hours and during periods of rain.

U.S. Pat. No. 5,536,569 to Lasch, James E., et. al., and assigned to Minnesota Mining and Manufacturing Company, describes a conformable pavement marking with a top surface useful as a marking indicium and a bottom surface, the marking sheet comprising a conformance layer with a thickness of 75 to 1250 micrometers of a composite material. The composite material should include 50 to 85 volume percent of a ductile thermoplastic polymer selected from the group consisting of polyethylene, polypropylene, polybutylene, ethylene copolymers, polyvinylidene fluoride, polytetrafluoroethylene, polyvinyl polymers, polyamides, and polyurethanes, and 15 to 50 volume percent mineral particulate with a mean particle size of at least 1 micrometer. The conformance layer requires, when tested at 25 degrees Celsius using a standard tensile strength apparatus, not more than 35 Newtons force per centimeter of width to deform a sample to 115% of the original sample length when tested at a strain rate of 0.05 sec−1. The top layer is distinct from the conformance layer, 80-250 micrometers thick, and is made of a thermoplastic polyolefin.

U.S. Pat. No. 6,790,880 to Purgett, Mark, et. al., and assigned to 3M, describes a pavement marking comprising a binder having polyurea groups, wherein the binder is prepared from a coating composition comprising one or more aliphatic secondary amines, one or more polylsocynanates, and at least about 15 weight percent non-soluble material based on the weight of the final dried coating, and reflective elements. The patent also discloses the pavement marking wherein the binder is a sprayable, two-part coating composition.

U.S. Pat. No. 6,116,814 to Dietrichson, Stein, and assigned to Rieber & Son, Division Nor-Skilt, describes a method for applying markings or signs on a surface in which a primer layer comprising an uncured plastic material with two or more components is applied to the surface, a heated mass comprised of a thermoplastic material is laid down on the primer layer, and the curing of the primer layer is initiated by the heat of the aforementioned heated mass.

U.S. Pat. No. 3,664,242 to Harrington, Thomas, et. al., and assigned to Minnesota Mining and Manufacturing Company, describes a method for forming a marking on a roadway that is ready to bear wheeled road traffic within seconds after application. First, the surface of the roadway is momentarily heated to a temperature between 150 and 500 degrees Fahrenheit. Next, the thus-heated roadway is projected toward a marking material that comprises a continuous stream of solid particles that are capable of passing a screen of about 20 mesh with at least about 80 weight percent being retained on a screen of about 200 mesh, are non-tacky, non-blocking, free-flowing, and solid at temperatures up to about 120 degrees Fahrenheit, and include a coloring agent in an amount sufficient to color a marking formed from the marking material and an organic thermoplastic phase that accounts on the average for at least about 25 volume percent of the marking material and principally comprises a polyamide condensation product of polycarboxylic acid and polyamine. Finally, the individual particles are heated as the proceed toward the roadway to a temperature above 150 degrees Fahrenheit sufficient to at least soften a major portion of the organic thermoplastic phase of the particles before they reach the pavement, the heated condition of the roadway and the particles being such that the particles wet and bond rapidly to the surface of the pavement and coalesce into a film, which subsequently becomes solid, non-tacky, and capable of bearing wheeled road traffic without tracking.

Great Britain Patent Application No. GB 2429978A to Aubree, Barry Mark, and assigned to Barry Mark Aubree, describes a method of producing a thermoplastic road-marking composition that comprises mixing an opaque pigment, a translucent particulate thermoplastic material and reflective glass beads such that when the thermoplastic material is subsequently melted to bind the composition and the composition is laid as a marking, the glass beads on the visible surface of the markings are not substantially obscured by the opaque pigment. The application also presents a thermoplastic road-marking composition comprising a mixture of a particulate filler material, a pigment, a translucent thermoplastic material and reflective glass beads wherein the pigment clings to the filler material and the reflective glass beads are generally clear of the pigment. Accordingly, the thermoplastic road-marking immediately has retroreflectivity without the requirement for an additional operation of adding glass beads to the surface of the marking and without the need to let the road-marking wear before it becomes retroreflective.

WIPO Patent Application No. WO03064771A1 to Hong, Le Hoa, et. al., and assigned to Avery Dennison Corporation, describes a method for securing a preformed pavement marking construction with a top surface and at least one perimeter edge to pavement with a relatively flat roadway surface. The method includes adhering the preformed pavement marking construction the roadway surface, providing a curable structural adhesive, and applying the curable structural adhesive to the at least one perimeter edge such that the curable structural adhesive overlaps a portion of the top surface of the preformed pavement marking construction at its at least one perimeter edge and a portion of the roadway surface. Finally, the curable structural adhesive is cured to form a traffic-bearing top surface extending between the roadway surface and the preformed pavement marking construction.

The disclosed review of the relevant art shows the need for a thermoplastic pavement marking method using an adhesive (sprayable or otherwise) that maintains the integrity of the pattern and a thermoplastic pavement marking composition that includes large grit size aggregate to improve long term skid resistance and reduce tire-tracking.

BRIEF DESCRIPTION OF THE DRAWINGS

FIG. 1 is a diagram of a type of preformed thermoplastic pavement marker, which is more fully described below.

DETAILED DESCRIPTION OF THE DRAWINGS

FIG. 1 illustrates a typical partial decorative pavement marking pattern (10) for application to concrete, asphalt or other suitable substrates. Marking pattern (10) is a brick and mortar pattern used herein for illustration purposes but as would be understood various other thermosetting and thermoplastic patterns are commercially available such as (90) herringbone, cobblestone, pavement slabs, horizontal signage, logos and other designs. Also, while many colors are available for the pavement marking patterns, typically different sections of each pattern are of different colors, such as a "light" grid or mortar color and a "darker" brick or insert color. The marking patterns typically consist of two or more sections.

Preferred marking pattern (10) shown for demonstration purposes consists of two separate thermoplastic sections, first section (11) represents a grid or mortar joint and second section (12) represents a brick or insert (14) with borders (18) as represented. Sections (11) and (12) are generally formed independent of each other due to the differences in color. Pavement marking pattern (10) is planar and is conventionally formed from a standard thermoplastic. The top portion (11) of the marking pattern is bordered. Large aggregates (20) are shown throughout the marker patterns.

SUMMARY OF THE INVENTION

The present disclosure describes a preformed thermoplastic pavement marking or hot melt applied material with improved long term skid resistance and reduced tire tracking once the pavement marking has been adhered to road surfaces or other solid substrates. The need exists to produce preformed thermoplastic pavement marking materials with improved skid resistance, especially for use in wet conditions and over long term use to reduced tire tracking—a real detriment to the usefulness of thermoplastic pavement markings in locations where they are desirable. The preformed thermoplastic material of the present invention is comprised of about 20% binder and 80% "intermix", where the intermix includes non-organics such as silica, calcium, and other inorganic pigments as well as large high friction aggregate capable of passing through sieves sizes of about 4 to about 12 together with somewhat smaller aggregate that is applied to the surface either prior to, or during installation. The surface applied anti-skid materials provide high initial friction properties, while large size aggregate in the intermix provides long term skid resistance and improves initial friction properties by creating an appropriately textured surface.

To achieve the desired traction and friction properties it should be recognized that there is a difference between slip resistance, which relates to traffic traveling over the pavement markers at a slow speed and to pedestrian traffic traveling over the same pavement marker surfaces and related to the static COF (coefficient of friction). Skid resistance relates, however to traffic traveling over the pavement markers at high speed, and depends on surface texture. Skid resistance is more applicable to the type of vehicular traffic.

Common test methods for measuring the effectiveness of these pavement markers for slip and skid resistance include BPN (ASTM E303), which is the most commonly used test methodology but does not reflect performance at high speeds and does not provide for measuring static COF values.

Instead, the "Locked Wheel Test" which produces "FN" or Friction number and described by ASTM E274 is used by many states within the United States and provides a methodology for measuring friction values at high speeds, simulates real traffic conditions, and requires actual road installation. There are also other test methods for measuring friction at high speeds. Results from different test methods can be normalized or combined using the IFI (International Friction Index, ASTM E1960) which provides for combining friction and texture indices (F60 and $S_p$).

The required materials for the present invention to achieve both the necessary slip and skid resistance are those that contain high friction large aggregates in the intermix with a weight percent content of from 5 percent to 65 percent. The optimal size of the large aggregates is from about 4 to about 16 grit (about 0.5 to about 1.0 millimeters) depending on the specific thickness of the thermoplastic sheets that contain the marker patterns—confirm sizes The present invention also includes cases where the thermoplastic road marker patterns contain surface applied large aggregate in a range from about 14 to about 20 grit (about 0.8 mm to about 1.2 mm) Product using small particle aggregate sizes (approximately 24 grit or mesh) covered the surface area of the thermoplastic marking sheets more effectively, however, these aggregates did not provide the required skid or tire track resistance.

It has been shown that it is possible to use single grit size aggregate in the intermix. The use of an intermix of different grit sized aggregates in different proportions based on the need for the future use of different materials (larger sizes for thicker and larger thermoplastic sheets and smaller aggregates for narrow strips) is also part of the present disclosure.

The aggregates used primarily exhibit a Mohs hardness of greater than 6, including corundum, quartz, granite, calcined clay, nickel slag, silicon dioxide and others (trade names of such materials include Mulcoa grades 47, 60 and 70, AlphaStar®, Ultrablast®, and Alodur® which provide hardness ratings in the range of 6.5 to 9). A portion of the intermix used with the thermoplastic road marking includes 16 grit size aggregate also with a hardness in the Mohs scale reading of greater than 6, which has never been tried before in preformed or hot melt applied thermoplastic surface applications, and has resulted in improved friction.

An additional desired result is improved overall skid resistance of the preformed thermoplastic markers without any associated discoloration. The aforestated special aggregates also improve the coefficient of sliding friction (COF) as determined per the ASTM E274 test. As the COF decreases below a certain level on the surrounding asphalt, a small wheel grabs onto the asphalt and if the COF is reduced on the pavement marking too much, undesirable skidding will occur. It is desirable that the COF of the preformed or hot melt thermoplastic match or be greater than the road pavement surface. The COF, in this case, as measured per ASTM E274 requires using a small cart pulled behind a car with a wheel attached to the bottom of the cart that rides at the speed of the car, thus touching the pavement surface, which eventually results in locking the wheel, thereby allowing for measurement of the force of the cart on the surface.

In this case, the result of using large particle aggregates is anti-intuitive, in that as there is more "gripping" to the thermoplastic marker surface adhered to the underneath pavement surface, the traffic that travels over this maker pavement surface with the special aggregate results in providing less tire tracking and skid marks. Tire tracking is measured by the size and number of undesirable resultant markings caused by traffic as well as discoloration of the thermoplastic marking surface. The reduction in COF does, however, correlate with increasing skid and when the COF increases, this will correlate with decreasing skid.

Therefore, a surprising result found during the course of experimentation and resulting in an important embodiment of the present application is that these thermoplastic marking surfaces stay cleaner and possess less tire tracking than marking surfaces without the special large aggregate particles described above.

There is a strong need in the industry to provide a layer of preformed thermoplastic so that these marking surfaces are skid resistant and are used for any crosswalk material. There is also a requirement that the skid resistance (which is quantified by friction number) also provides tire tracking reduction.

An additional embodiment and surprising result is that in the past, without the use of these large aggregate materials, the wheel path or track is almost always darker in the section of the surface where the vehicle travels over the marking, so that normal free rolling traffic which passes over the thermoplastic pavement markers will cause darkening. In the case of the present invention, this is not true and this undesirable result has been eliminated. The turning traffic, which causes more tire shear, also does not cause darker tire tracking.

In the present invention, the use of uniform particulate material or blends of particulate materials for the aggregate with differing hardness values, providing more economical solutions, can be introduced into the intermix during formulation. The introduction of these blends usually occurs prior to extrusion and completion of the thermoplastic pavement marking. The aggregates and other particles such as glass beads and the inorganic choices stated above can also, however, be dropped on the hot material during installation and completely embedded into body of the thermoplastic marking material in that fashion. The preformed thermoplastic surface marking product can be applied using pressure sensitive adhesives as well as by flame torching.

The resultant properties of the (once applied) thermoplastic marking surfaces were measured using International Friction Index (IFI) consisting of two parameters:

F60—calibrated friction at 60 km/h calculated from DFT20–friction measured at 20 km/h $S_p$—speed constant that depends on surface texture presented as MPD (mean profile depth, mm).

Materials without large high friction aggregate have an F60 of about 0.07 to about 0.10 and an MPD of 0.15 mm to about 0.3 mm. Depending on the aggregate size used in the present invention, when the intermix becomes exposed, the F60 increases to between about 0.17 to about 0.4 and the MPD to between about 0.50 mm to about 0.75 mm. For comparison hot mix asphalt has an F60 value of about 0.25 after being exposed to traffic extended lengths of time.

In addition, in recent years increasing numbers of municipalities, office complexes, shopping centers and other commercial developments have utilized thermoplastic pavement markings with various patterns and designs to guide, decorate, and protect high traffic areas such as highways, pedestrian crosswalks, parking lots and business entrances. Such patterns may include a first section or grid, for example to represent the mortar joints in a "brick" design and a plurality of second sections or "bricks" which are coplanar therewith, usually in a color different from the mortar color. The second section or bricks which are separately manufactured are inserted into the first section or grid before application of the pattern to the pavement. Various two section marking patterns are commonly available such as: herringbone, standard brick, cobblestone, paving slabs and many other designs. Marking patterns with more than two sections are also commonly available such as horizontal highway and street signage, logos and many others.

As hereinbefore mentioned, these marking patterns consist of two or more independent sections which must be carefully assembled and handled before applying to pavements such as asphalt, concrete or other suitable substrates. These marking patterns are placed at desired locations such as road crosswalks, intersections, parking lots or other sites. In some cases heat is then applied to soften the pavement marking pattern causing it to firmly adhere to the substrate. Various adhesives can also be used to adhere the marking pattern to the substrate.

While the purchase of such pavement marking patterns is relatively inexpensive, much time and labor is devoted to the assembly and application of the pattern to the substrate. Most patterns consist of two or more sections which are independently formed for manual assembly at the job site and time and effort is needed to assemble and maintain the integrity of a pattern before the heat treatment. Usually the pattern placed on the substrate must be moved manually for adjustment purposes. During such movement, the independent sections in the pattern inadvertently become unaligned, requiring reinsertion or realignment. If the realignment is not precisely accomplished, the marking pattern will have lost its integrity and the entire pattern must be removed manually from the substrate, the substrate cleaned and a second attempt at the application made with the reinserted or new marking pattern. This re-application results in extra time, labor, and materials. In the past, to maintain the integrity of the marking pattern before the heat treatment and during the handling and placement, "spot adhesives" have been used which remain somewhat "tacky" after being applied to the bottom of the patterns at the grid intersections to maintain pattern integrity. However, these small adhesive circles or "spots" are generally a different type of polymer than the marking pattern and can prevent proper attachment and easy movement of the marking pattern on the substrate at the spot adhesive locations before and during the heat application of the marking. Also, certain spot adhesives are not compatible with the plastic materials from which the patterns are formed and can cause the pavement marking sections to separate from the substrate after the heat application, as only a weak bond is formed with the substrate.

The major object of the present invention is to provide for long term skid resistance and reduced tire tracking through the addition of large grit size aggregate. The above stated objectives are realized by providing a conventional pavement marking pattern formed of a thermosetting or thermoplastic which may have two or more sections, manually joined by bridging the bottom surface thereof with an adhesive having substantially the same temperature softening point as the sections of the marking pattern. The adhesive can be sprayed primarily along the intersections of the pattern to cover a percentage (approximately from 5% to 90%) of the patterned bottom surface area while bridging the intersections. The more intricate the pattern (with more joints or intersections) the greater the percentage of adhesive coverage required. The spray adhesive can be a typical polyamide, EVA based hot melt adhesive or other, such as styrene-isoprene-styrene copolymers, styrene-butadiene-styrene copolymers, ethylene ethyl acrylate copolymers, and polyurethane reactive, and preferably consists of a hot melt polyamide resin based adhesive which is sprayed in a circular or spiral string like configuration at a temperature at or above its softening point. The sprayed hot adhesive strikes the marking pattern and adheres, bridging and bonding the pattern sections to maintain pattern integrity during subsequent handling. Uni-Rez 2633 as sold by Arizona Chemical Company of P.O. Box 550850, Jacksonville, Fla. 32225 is the main ingredient in the preferred hot melt adhesive. The preferred hot melt adhesive is formulated with Uni-Rez 2633, ester modified rosins, fillers, extenders, levelers and other conventional components.

In a typical manufacturing process, various sections of a pavement marking pattern (e.g. a brick and mortar pattern or any other desired pattern) are factory assembled and while in assembled form, the bottom of the pattern is sprayed with the hot melt adhesive described above using preferably spray gun model: Hysol-175-spray as manufactured by Loctite Corporation of 1001 Tout Brook Crossing, Rocky hill, Connecticut 06067, having various pressures and nozzle settings to select from, depending on the viscosity of the particular adhesive employed. A circular or spiral string-like adhesive configuration is preferred for the spray.

Once the sprayed hot melt adhesive has cooled, the grid and inserts are suitably bridged and joined and the pavement marking pattern is packaged for shipment. Upon receipt at the job site, the packages are opened and after the intended substrate, usually asphalt or concrete is properly cleaned and swept, the marking pattern is then placed on the substrate without concern of disassembly during handling, movement and adjustment. Once suitably placed, a heat application is delivered from a conventional source which softens the marking pattern and the underlying sprayed adhesive, both of which have the approximate same temperature softening point to thereby affix the pavement marking pattern to the substrate. Time and labor are thereby saved as the marking pattern sections have been adhered to form a unified pattern by the hot melt adhesive.

As stated above, the present invention includes larger grit size aggregate than is normally used in similar preformed thermoplastic pavement marking products. Specifically, the aggregate should be between 8 and 12 mesh (grit) in size and may be comprised of quartz, corundum, crushed gravel, crushed granite, or any combination thereof. The aggregate used may also measure 6 or greater on the Mohs Hardness Scale. This larger grit size improves the skid resistance properties of the pavement marker and also significantly reduces tire tracking in comparison to other similar products, because it ensures that the product wears down more slowly, conveying greater durability and also longer term skid resistance—often through the end-of-life of the applied preformed thermoplastic.

Other advantages achieved using these working examples include the fact that when the surface applied aggregate provides high initial skid resistance using aggregate in the intermix, the surface maintains high skid properties during the entire period of use of the pavement markings and also provides increasing skid resistance.

Another unexpected effect of the use of large aggregate intermix within the preformed thermoplastic or hot melt applied markers, is the decrease or essentially complete elimination of tire skid marks on the thermoplastic marking surfaces. Bigger aggregates leading to reduction or elimination of tire tracking was also an unexpected result.

Among additional objectives of the invention include providing a relatively inexpensive pavement marking pattern having two or more sections in which the sections are joined by use of an applied adhesive and to provide a method for forming a pavement marking pattern which allows cost efficient factory assembly of the pattern and which prevents dislodging and separation of the pattern sections during handling, transportation and application.

Other objects of the invention are to provide an adhesive which can be conveniently sprayed onto the back of pavement marking patterns which will sufficiently adhere thereto and prevent separation of the sections during handling, and not deteriorate the bond between the pavement marking pattern and the substrate and to provide a method for easy application of the adhesively sprayed marking pattern to the substrate.

It should be understood that although examples are given it should not be construed that these are examples provide the only examples of the invention and that variations of the present invention are possible, while adhering to the inventive concept herein disclosed.

Incorporation of large grit aggregate into the pavement marking pattern allows for manufacturing with decorative markings on the surface of the preformed thermoplastic sheets that provides excellent anti-skid properties.

WORKING AND COMPARATIVE EXAMPLES

Test Methodology

The surface texture of the preformed thermoplastic is measured using a laser-based Circular Track Meter (CTM) with a vertical resolution of 3 microns (μm). The texture is reported in terms of the Mean Profile Depth (MPD) in millimeters. Then the friction of the surface is measured using a Dynamic Friction Tester (DFT). In the DFT, a disk with three rubber sliders attached to the disk rotates at tangential velocities up to 90 km/h then drops onto the surface. The torque generated, as the disk slows once it engages the surface, provides an indication of the friction at various speeds. The output from the DFT is reported as unitless DFT numbers at various speeds (typically 20, 40, 60 and 80 km/h). The DFT and CTM instruments are manufactured by NIPPO Sangyo Co. (Japan). Together, the results from the CTM and DFT are used to calculate a value known as the International Friction Index (IFI, F60). The IFI can also be estimated by other types of equipment including the widely used ASTM E274 towed friction trailer test method as well as the British pendulum test method and results of different test methods have been found to correlate.

Working Example 1

An example of the hydrocarbon resin composition for the preformed thermoplastic of the present invention is provided as follows:

Material Composition

| | |
|---|---|
| Escorez 1315 - | 10% |
| C5 hydrocarbon resin - | 5% |
| Refined mineral oil - | 2% |
| Escorene EVA MV 02514 | 3% |
| Fumed silica - | 0.5% |
| Titanium dioxide (Rutile) - | 10% |
| Glass beads Type 1 - | 30% |
| Corundum Grit 12 | 20% |
| CaCO3 - | 19.5% |

The material composition has a softening temperature (Ring and Ball) of 118° C. measured according to ASTM D36-06 entitled "Standard Test Method for Softening Point of Bitumen (Ring-and-Ball Apparatus)".

The thermoplastic material composition was extruded using a casting die to create 125 mil thick preformed thermoplastic sheets. As the sheets were extruded glass beads were dropped onto the melted thermoplastic material. Subsequently at a location further from the die exit on the manufacturing line, corundum grit 16 was added to the thermoplastic and indented visual heating indicators were applied to the surface.

Using a Flint-2000 propane torch, the material composition was applied on two square cement boards (20 inches by 20 inches). One of the panels was tested after application, another was abraded (sand blasted) to expose the intermix aggregate.

The properties of material tested with DFT and CTM as described above are provided in Table 1 below;

TABLE 1

DFT, F60, and M1PD Values for Working Example 1

| Example 1 | DFT20 | F60 | MPD, mm |
|---|---|---|---|
| As Applied | 0.733 | 0.425 | 0.61 |
| After Abrasion | 0.853 | 0.455 | 0.71 |

Working Example 2

An example of preformed thermoplastic material based on an alkyd resin composition is provided as:

Material Composition for Working Example 2

| | |
|---|---|
| Polyamide resin Uni-Rez 2633 | 7.2% |
| Modified rosin resin Sylvacote 4981 - | 6.8% |
| Phthalate plasticizer - | 2.8% |
| PE based wax - | 2.0% |
| Fumed silica - | 0.5% |
| Corundum grit 16 | 30% |
| TiO2 - | 10% |
| CaCO3 - | 40.7% |

The material composition softening temperature (R&B) is 124° C.

The material composition was extruded, applied on cement boards, and tested similarly to the Example 1 except that corundum grit 24 was dropped on the surface during extrusion. The results are provided in Table 2 below:

TABLE 2

DFT, F60, and MPD Values for Working Example 2

| Example 2 | DFT20 | F60 | MPD, mm |
|---|---|---|---|
| As Applied | 0.517 | 0.266 | 0.463 |
| After Abrasion | 0.794 | 0.379 | 0.51 |

Working Example 3

Alkyd type base layer for hot applied formulation

| | |
|---|---|
| Modified rosin resin Sylvacote 4981 - | 8% |
| Modified rosin resin Sylvacote 7021 - | 9% |
| Castor oil based plasticizer - | 3% |
| PE based wax - | 2.0% |
| Quartz mix with grit 12 to 20 gradation | 30% |
| TiO2 - | 10% |
| CaCO3 - | 38% |

The material composition softening temperature (R&B) is 121° C.

The formulation, after mixing, provided 4-inch wide draw-down plaques. No anti-skid aggregate was applied to the surface of the plaques. While still warm and sufficiently flexible the draw-down plaques were applied to the cement boards covering the entire 20×20 inch area and creating sufficient space for testing, using CMT and DFT testers. One of the boards was tested after application and another after abrasion by sand blasting to expose intermix aggregate.

TABLE 3

DFT, F60, and MPD Values for Working Example 3

| Example 3 | DFT20 | F60 | MPD, mm |
|---|---|---|---|
| As Applied | 0.15 | 0.13 | 0.34 |
| After Abrasion | 0.70 | 0.33 | 0.46 |

Working Example 4

An application of preformed thermoplastic insignia using adhesive backed preformed thermoplastic sheeting was also tested. Pressure sensitive adhesive (PSA) was applied to the sheets of material made according to the Example 2 and pre-cut in the shape of AASHTO approved letters. The letters were applied at the intersection to create a warning "STOP" sign using a READYMARK tamper. The friction properties of these preformed thermoplastic sheets yielded results similar to the "as applied" properties presented in Example 2.

Working Example 5

A decorative brick pattern was made using colored and patterned thermoplastic sheeting manufactured according to the Example 1 including a dark red color for bricks and a white color for the grout. The sections of the patterned thermoplastic sheeting were joined together using EVA based hot melt adhesive. Sheeting was applied to the cross-walk and exhibited properties similar to the "as applied" properties presented in Example 1.

Working Example 6

Alkyd Based Material with Blended Large Aggregate Intermix

Material Composition for Working Example 6

| | |
|---|---|
| Polyamide resin Uni-Rez 2633 - | 7.5% |
| Modified rosin resin Sylvacote 4981 - | 6.5% |
| Phthalate plasticizer - | 3.2% |
| PE based wax - | 1.6% |
| Fumed silica - | 0.5% |
| Corundum grit 12 | 5% |
| Mulcoa 47, gradation 8-20 grit | 25% |
| TiO2 - | 10% |
| CaCO3 - | 40.7% |

Material was processed according to Example 1, with a 90 mil thickness and corundum grit (or mesh size) 24 was applied during extrusion.

TABLE 4

DFT, F60, and MPD Values for Working Example 4

| Example 6 | DFT20 | F60 | MPD, mm |
|---|---|---|---|
| As Applied | 0.47 | 0.248 | 0.46 |
| After Abrasion | 0.754 | 0.392 | 0.51 |

Comparative Example 1

As an illustration, Comparative Example 1 uses smaller aggregate in the intermix. The preformed thermoplastic was identical to that of Working Example 2, except that the Corundum grit 30 was used in the intermix and as a drop on instead of corundum grit 16.

Material Composition for Comparative Example 1

| | |
|---|---|
| Polyamide resin Uni-Rez 2633 - | 7.2% |
| Modified rosin resin Sylvacote 4981 - | 6.8% |
| Phthalate plasticizer - | 2.8% |
| PE based wax - | 2.0% |
| Fumed silica - | 0.5% |
| Corundum grit 30 | 30% |
| TiO2 - | 10% |
| CaCO3 - | 40.7% |

TABLE 5

DFT, F60, and MPD Values for Comparative Example 1

| Comp. Example 1 | DFT20 | F60 | MPD, mm |
|---|---|---|---|
| As Applied | 0.42 | 0.192 | 0.28 |
| After Abrasion | 0.36 | 0.172 | 0.26 |

The data shown above, in Table 5 when compared with the previous Tables (1-4) clearly indicates the (heretofore unexpected) improvement over the small size corundum after abrasion (wear) for DFT20 (0.70 vs. 0.36) and calibration friction number F60 (0.35-0.45 vs. 0.17).

The invention claimed is:

1. A preformed thermoplastic marking comprising:

a plurality of thermoplastic sections including planar top surfaces, planar bottom surfaces, and an adhesive on at least a portion of said bottom surfaces, wherein said planar top surfaces of each of said plurality of thermoplastic sections comprise features representing a pattern of said thermoplastic sections, wherein said features comprise alphanumeric characters, symbols, or combinations thereof, wherein said plurality of thermoplastic sections comprise 18.8 to 20 weight percent of a binder comprising an alkyd resin, the alkyd resin comprising a polyamide resin, a modified rosin resin, a phthalate plasticizer, and a polyethylene (PE) wax, the alkyd resin including a higher weight percentage of the phthalate plasticizer than the PE wax, wherein said plurality of thermoplastic sections comprise light reflective beads embedded within their surface, wherein the light reflective beads comprise glass, and wherein said plurality of thermoplastic sections further comprise an indented visual heating indicator located on the planar top surface of the thermoplastic sections.

2. The preformed thermoplastic marking of claim 1, wherein the thermoplastic sections include anti-skid materials embedded within the surface of the plurality of thermoplastic sections.

3. The preformed thermoplastic marking of claim 1, wherein said plurality of thermoplastic sections abut each other.

4. The preformed thermoplastic marking of claim 3, wherein said plurality of thermoplastic sections are configured to be adhered to a substrate using a propane-fueled heater, an open flame, or a closed flame.

5. The preformed thermoplastic marking of claim 1, wherein said plurality of thermoplastic sections have interlocking edges.

6. The preformed thermoplastic marking of claim 1, wherein said plurality of thermoplastic sections are configured to adhere to a substrate upon the application of heat.

7. The preformed thermoplastic marking of claim 1, wherein said visual heating indicator is configured to indicate the thermoplastic marking has been heated to a predetermined temperature.

8. The preformed thermoplastic marking of claim 1, further comprising a filler comprising at least one of:

calcium carbonate;

glass beads;

fumed silica; or aggregate.

9. The preformed thermoplastic marking of claim 8, wherein said composition further comprises a pigment.

10. The preformed thermoplastic marking of claim 8, wherein said composition further comprises titanium dioxide.

11. The preformed thermoplastic marking of claim 1, said plurality of thermoplastic sections having a marking grid, a plurality of inserts and an insert pattern, such that each of said inserts are separated by said grid.

12. The preformed thermoplastic marking of claim 11, wherein said marking grid, inserts, and insert pattern include an adhesive on a portion of the planar bottom surface with a softening point in a range of 90 degrees Centigrade to about 210 degrees Centigrade.

13. The preformed thermoplastic marking of claim 11, wherein said adhesive has a softening point in a range of about 118 degrees Centigrade to about 124 degrees Centigrade.

14. The preformed thermoplastic marking of claim 1, wherein said adhesive is an ethylene vinyl acetate (EVA) based hot melt or other hot melt polyamide resin.

15. The preformed thermoplastic marking of claim 1, wherein the adhesive comprises ethylene vinyl acetate (EVA) or a styrene-butadiene-styrene (SBS) elastomer.

16. The preformed thermoplastic marking of claim 1, wherein the planar top surfaces of each thermoplastic section are configured to be coplanar to each other, and the planar bottom surfaces of each thermoplastic section are configured to be coplanar to each other.

17. A method of affixing a preformed thermoplastic marking to a substrate comprising:

selecting a plurality of preformed thermoplastic sections, said thermoplastic sections comprising:

planar top surfaces and planar bottom surfaces, the bottom surfaces of the plurality of thermoplastic sections having an adhesive on at least a portion of said bottom surfaces;

said planar top surfaces of each of said plurality of thermoplastic sections including features comprising alphanumeric characters, symbols, or combinations thereof;

said plurality of thermoplastic sections comprise 18.8 to 20 weight percent of a binder comprising an alkyd resin, the alkyd resin comprising a polyamide resin, a modified rosin resin, a phthalate plasticizer, and a polyethylene (PE) wax, the alkyd resin including a higher weight percentage of the phthalate plasticizer than the PE wax, said plurality of thermoplastic sections having embedded within their surface light reflective beads that comprise at least one of glass, ceramic, corundum, or crushed glass;

said planar top surfaces of each of said plurality of thermoplastic sections further including an indented visual heating indicator;

identifying the features located within the planar top surfaces of each of the thermoplastic sections, the sequential features representing a pattern;

arranging the thermoplastic sections on a substrate in the pattern indicated by the features on the planar top surfaces; and applying heat to the planar top surfaces of said plurality of thermoplastic sections monitoring said visual heating indicator until the bottom surfaces of the thermoplastic sections adheres to the substrate.

18. The method of claim 17, wherein selecting preformed thermoplastic sections, said light reflective beads embedded within the surface of the plurality of thermoplastic sections are textured such that contact with the light reflective beads generates friction.

19. The method of claim 17, wherein applying heat to the planar top surfaces of said plurality of thermoplastic sections further comprises heating the thermoplastic sections to a temperature of about 244 degrees F. or higher.

20. The method of claim 19, wherein applying heat to the planar top surfaces of said plurality of thermoplastic sections comprises heating the thermoplastic sections to a temperature of about 400 degrees F. or higher.

21. The method of claim 17, wherein the indent is in the form of a dimple.

22. The method of claim 17, wherein the visual heating indicator comprises a bump or a raised marker.

23. The method of claim 17, wherein selecting preformed thermoplastic sections, the visual heating indicator located within the planar top surfaces of each of the thermoplastic sections comprising a second visual heating indicator.

24. The method of claim 17, wherein arranging the thermoplastic sections on the substrate in the pattern indicated by the features on the planar top surfaces includes arranging the thermoplastic sections to abut each other.

25. The method of claim 17, wherein selecting preformed thermoplastic sections further includes selecting preformed thermoplastic sections having interlocking edges.

26. The method of claim 25, wherein arranging the thermoplastic sections on the substrate in the pattern indicated by the features further includes arranging the thermoplastic sections to have interconnected edges.

27. The method of claim 17, wherein the adhesive is pre-bonded to the bottom surfaces of the plurality of thermoplastic sections prior to transport of the sections to the location where the sections are arranged on the substrate.

* * * * *